US005841219A

United States Patent [19]

Sadwick et al.

[11] Patent Number: 5,841,219

[45] Date of Patent: Nov. 24, 1998

[54] MICROMINIATURE THERMIONIC VACUUM TUBE

[75] Inventors: Laurence P. Sadwick; R. Jennifer Hwu, both of Salt Lake City; J. Mark Baird, Sandy; Sherman Holmes, Bountiful, all of Utah

[73] Assignee: University of Utah Research Foundation, Salt Lake City, Utah

[21] Appl. No.: 778,789

[22] Filed: Jan. 6, 1997

Related U.S. Application Data

[63] Continuation of Ser. No. 547,670, Oct. 17, 1995, which is a continuation of Ser. No. 126,075, Sep. 22, 1993.

[51] Int. Cl.[6] ..... H01J 1/62

[52] U.S. Cl. ..... 313/293; 313/15; 313/42; 313/46; 313/237; 313/250; 313/495

[58] Field of Search ..... 313/46, 15, 42, 313/237, 250, 293, 495

[56] References Cited

U.S. PATENT DOCUMENTS

| | | | |
|---|---|---|---|
| 3,665,241 | 5/1972 | Spindt | 313/351 |
| 3,701,919 | 10/1972 | Geppert | 313/250 |
| 3,748,522 | 7/1973 | Geppert | 313/310 |
| 3,755,704 | 8/1973 | Spindt | 313/309 |
| 3,824,478 | 7/1974 | Mueller | 377/79 |
| 3,970,887 | 7/1976 | Smith | 313/309 |
| 3,978,364 | 8/1976 | Dimef et al. | 313/306 |
| 3,983,442 | 9/1976 | Jariwala et al. | 313/251 |
| 4,019,081 | 4/1977 | Buxbaum et al. | 313/346 R |
| 4,020,381 | 4/1977 | Oess | 313/502 |
| 4,163,949 | 8/1979 | Shelton | 327/600 |
| 4,298,814 | 11/1981 | Takanashi et al. | 313/302 |
| 4,429,250 | 1/1984 | Clerc et al. | 313/336 |
| 4,513,308 | 4/1985 | Greene | 313/351 |
| 4,658,181 | 4/1987 | Cooper et al. | 313/346 R |
| 4,683,399 | 7/1987 | Soclof | 313/537 |
| 4,712,039 | 12/1987 | Hong | 313/307 |
| 4,721,885 | 1/1988 | Brodie | 313/576 |
| 4,780,684 | 10/1988 | Kosmahl | 330/54 |
| 4,855,636 | 8/1989 | Busta et al. | 313/306 |
| 4,924,137 | 5/1990 | Watanabe et al. | 313/337 |

(List continued on next page.)

OTHER PUBLICATIONS

Brodie "Physical Considerations in Vacuum Microelectronics Devices" IEEE Transactions on Elect. Dev. Nov. 1989 pp. 2641–2644.

Jiano et al. "Microcavity Vacuum Tube Pressure Sensor for Robot Tactile Sensing" IEEE 1991 pp. 238–240.

Thermionic Integrated Circuits: A Status Report by Wilde, Los Alamos, NM.

How Electron Tubes Are Used "Electron Tubes" pp. 3–1 to 3–3, author unknown.

(List continued on next page.)

*Primary Examiner*—Ashok Patel
*Assistant Examiner*—Matthew J. Gerike
*Attorney, Agent, or Firm*—Madson & Metcalf

[57] ABSTRACT

An integrated circuit vacuum tube array includes an insulating or highly resistive substrate, electrically conductive materials disposed on the substrate to define and surround a plurality of first voids extending from the substrate upwardly through the material, a plurality of cathodes disposed on the material to bridge over the respective first voids, for emitting electrons when heated by circuitry that selectively heats the cathodes, first electrically resistive material disposed on the electrically conductive material to surround the cathodes and define a plurality of second voids thereabove, an electrically conductive grid disposed on the electrically resistive material to project partially into the second voids to define an opening in the grid above each cathode, for allowing the passage of electrons therethrough, circuitry to selectively apply a voltage to the grid to control electron flow and thereby control the electrical current produced at the anodes, second electrically resistive material disposed on the grid to define a plurality of third voids above the openings in the grid, and a plurality of electrically conductive anodes disposed on the second electrically resistive material over the third voids to receive electrons emitted by the cathodes and thereby produce an electrical current.

14 Claims, 5 Drawing Sheets

U.S. PATENT DOCUMENTS

| | | | |
|---|---|---|---|
| 4,983,878 | 1/1991 | Lee | 310/248 |
| 4,987,377 | 1/1991 | Gray | 330/54 |
| 5,007,873 | 4/1991 | Goronkin | 445/49 |
| 5,030,879 | 7/1991 | Dorks | 313/346 R |
| 5,038,070 | 8/1991 | Bardai et al. | 313/309 |
| 5,053,673 | 10/1991 | Tomii | 313/308 |
| 5,118,983 | 6/1992 | Morita et al. | 313/340 |
| 5,173,634 | 12/1992 | Kane | 313/306 |
| 5,181,874 | 1/1993 | Sokolich et al. | 445/24 |
| 5,199,918 | 4/1993 | Kumar | 445/50 |
| 5,203,731 | 4/1993 | Zimmerman | 445/24 |
| 5,216,324 | 6/1993 | Curtin | 313/495 |
| 5,220,238 | 6/1993 | Lee | 313/270 |
| 5,259,799 | 11/1993 | Doan et al. | 445/24 |
| 5,285,131 | 2/1994 | Muller et al. | 313/578 |
| 5,289,078 | 2/1994 | Kitao et al. | 313/310 |
| 5,381,069 | 1/1995 | Itoh et al. | 313/310 |
| 5,397,957 | 3/1995 | Zimmerman | 313/309 |
| 5,399,238 | 3/1995 | Kumar | 156/643 |
| 5,411,426 | 5/1995 | Boysel | 445/25 |
| 5,436,530 | 7/1995 | Suzuki et al. | 315/169.1 |
| 5,463,269 | 10/1995 | Zimmerman | 313/309 |
| 5,463,271 | 10/1995 | Geis et al. | 313/346 R |
| 5,463,277 | 10/1995 | Kimura et al. | 315/169.1 |
| 5,475,281 | 12/1995 | Heijboer | 313/337 |
| 5,502,314 | 3/1996 | Hori | 257/10 |
| 5,505,647 | 4/1996 | Sato et al. | 455/25 |
| 5,508,584 | 4/1996 | Tsai et al. | 313/497 |
| 5,541,466 | 7/1996 | Taylor et al. | 13/310 |
| 5,569,974 | 10/1996 | Morikawa et al. | 313/310 |
| 5,572,041 | 11/1996 | Betsui et al. | 257/10 |

OTHER PUBLICATIONS

"Flat Displays for Receivers and Monitors", J. Anderson et al., International Broadcasting Convention, Sep. 1994, pp. 483–488.

"Thermal Applications of Microbridges", C. Mastrangelo, UMI 1991, pp. 1–388.

"Fluorescent Indicator Panel with Simple Diode Construction", M. Yamaguchi et al., *SID Digest,* 1987, pp. 100–102.

"Color Graphic Front Luminous VFD", T.L. Pykosz et al., *SID Digest,* 1985, pp. 366–369.

"The Challenge of the Cathode–Ray Tube", N. Lehrer, pp. 138–236.

"Flat Panel Displays in Perspective", Office of Technology Assessment, Congress of the United States.

MICROMINIATURE THERMIONIC VACUUM TUBE

This application is a continuation of U.S. application Ser. No. 08/547,670, filed Oct. 17, 1995, for MICROMINIATURE THERMIONIC VACUUM TUBE, which application is a continuation of U.S. application Ser. No. 08/126,075, filed Sep. 22, 1993, now abandoned.

BACKGROUND OF THE INVENTION

This invention relates to microminiature thermionic vacuum tube devices such as diodes, triodes, tetrodes, and the like constructed with solid-state semiconductor device fabrication techniques to have ultra-small (i.e., micron-scale) dimensions.

Vacuum tubes were developed around the turn of the century and immediately became widely used for electrical amplification, rectification, oscillation, modulation, and wave shaping in radio, television, radar, and in all types of electrical circuits. With the advent of the transistor in the 1950's and integrated circuit technology in the 1960's, the use of the vacuum tube began to decline, as circuits previously employing vacuum tubes were adapted to utilize solid-state transistors and like circuit components. The result is that today more and more circuits are utilizing solid-state semiconductor devices, with vacuum tubes remaining in use only in limited circumstances such as those involving high power, high frequency, or hazardous environmental applications. In these last mentioned applications, solid-state semiconductor devices generally cannot accommodate the high power, high frequency or severe environmental conditions.

There have been a number of attempts at fabricating vacuum tube devices using solid-state semiconductor device fabrication techniques. One such attempt resulted in a thermionic integrated circuit formed on the top side of a substrate, with cathode elements and corresponding grid elements being formed co-planarly on the substrate. The anodes for the respective cathode/grid pairs were fabricated on a separate substrate which was aligned with the first-mentioned substrate such that the cathode to anode spacing was on the order of one mm. With this structure, all the cathode elements were collectively heated via a macroscopic filament heater deposited on the back side of the substrate. This structure required, therefore, relatively high temperature operation and the need of substrate materials which had high electrical resistivity at elevated temperatures. Among the problems with this structure were inter-electrode electron leakage, electron leakage between adjacent devices, functional cathode life, etc.

SUMMARY OF THE INVENTION

It is an object of the invention to provide a microminiature thermionic vacuum tube device which may be manufactured using solid-state semiconductor fabrication techniques to have ultra-small (i.e., micron-scale) dimensions.

It is also an object of the invention to provide such a device which may operate in generally harsh environments—high temperature, high radiation.

It is a further object of the invention to provide such a device which may be utilized in high electrical power and/or high frequency applications.

It is another object of the invention to provide such a device which is efficient and reliable in operation.

The above and other objects of the invention are realized in a specific illustrative embodiment of a microminiature thermionic vacuum tube device comprising an insulating or highly resistive substrate, electrically conductive materials disposed on the substrate to define and surround a first void extending from the substrate upwardly through the material, a cathode disposed on the material to bridge over the first void, for emitting electrons when heated, first electrically resistive material disposed on the electrically conductive material to surround the cathode and define a second void thereabove, an electrically conductive grid disposed on the electrically resistive material to project partially into the second void to define an opening in the grid above the cathode, for allowing the passage of electrons therethrough, second electrically resistive material disposed on the grid to define a third void above the opening in the grid, and an electrically conductive anode disposed on the second electrically resistive material over the third void to receive electrons emitted by the cathode and thereby produce an electrical current. The electrically conductive material is selectively heated to thereby heat the cathode and cause the emission of electrons; a positive voltage is applied to the anode to cause it to attract electrons and a voltage is selectively applied to the grid to control the magnitude of the flow of electrons through the opening in the grid, to thereby effect control of electrical current produced.

In accordance with one aspect of the invention, the first void is formed to extend downwardly into the substrate to form a column void below the cathode.

BRIEF DESCRIPTION OF THE DRAWINGS

The above and other objects, features and advantages of the invention will become apparent from the consideration of the following detailed description presented in connection with the accompanying drawings in which.

DETAILED DESCRIPTION

Figure 1A:
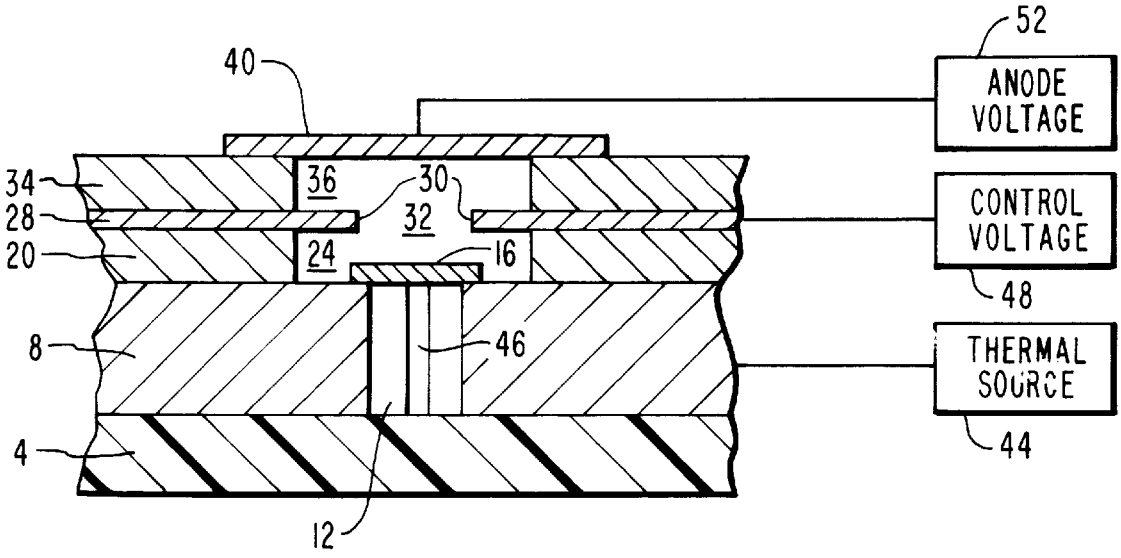
FIG. 1A is a side, cross-sectional view of a microminiature thermionic vacuum tube with a column void made in accordance with the principles of the present invention.

Referring to FIG. 1A, there is shown a side, cross-sectional view of one embodiment of a microminiature vacuum tube which may be fabricated using solid-state semiconductor fabrication techniques, such as thin film deposition, sputtering, etc. The device includes a substrate 4 which may be made of a single crystal, a polycrystalline material, a amorphous material, or other high resistivity semiconductor substrate material. For example, the substrate 4 might illustratively be made of polycrystalline silicon, amorphous silicon, silicon and gallium arsenide semiconductor substrates or the like.

Deposited on the substrate 4 are the component parts of the microminiature vacuum tube device, with these parts being shown greatly enlarged and out of scale to better illustrate the structure. A low resistance metal 8, such as gold, aluminum, intermetallic or the like, is deposited on the substrate 4 about a void 12. Deposited or formed over the void 12 and partially over the low resistance metal 8 is an element 16 which will serve as the cathode filament of the vacuum tube device. The cathode filament 16 is placed in contact with the low resistance metal 8 since it is via this layer that the cathode filament will be stimulated to emit electrons. As will be described later, this will be carried out by heating the cathode filament to cause it to thermionically emit the electrons. Disposition of the cathode filament 16 over the void 12 serves to reduce the thermal load and stress which might otherwise be imposed on the vacuum tube device during operation. In effect, the void 12 serves to localize the cathode filament heating element 16 to contain the heat therein. Advantageously, the cathode filament 16 is made of a refractory metal such as molybdenum, platinum, titanium, tungsten, or the like. These materials have a relatively low coefficient of expansion which, because of the small distances which will be present between the component parts of the vacuum tube device, are desirable to minimize the possibility of the component parts thermally expanding or growing to ultimately touch. The latter event, of course, would disable the vacuum tube device.

A resistive material 20 is deposited on the low resistance metal 8 and formed to define a void 24 which surrounds the cathode filament 16. The resistive material 20 might illustratively be ceramic, silicon dioxide or the like.

Deposited on the resistive material 20 is an electrically conductive grid layer 28, a portion of which 30 projects into the void 24 to define an opening 32 positioned directly above the cathode filament 16. The grid layer 28 might illustratively be made of tungsten, gold, tantalum or the like. The grid layer 28, and in particular the projections 30, serve as a conventional grid in a triode vacuum tube structure.

Deposited on the grid layer 28 is another layer of resistive material 34, formed to define a void 36 which is above the opening 32 in the grid layer 28, as shown in FIG. 1A. The resistive material 34 may be the same as the resistive material of layer 20.

Deposited on the resistive layer 34 to bridge over the void 36 is an electrically conductive anode 40. The electrically conductive material 40 may be the same as the electrically conductive material of layer 28. As can be seen, the anode 40 is positioned vertically above the void 36, the opening 32 in the grid layer 28, the void 24, and the cathode filament 16. This provides a vertically oriented, solid-state thermionic, triode vacuum tube device which is immune to high temperatures and harsh environments such as those with high radiation.

The device of FIG. 1A would be operated in essentially the same fashion as that of a conventional vacuum tube including a source of thermal energy 44 coupled to the low resistance metal layer 8 for providing heat to heat the cathode filament 16 and cause it to emit electrons. The thermal source of energy 44 might illustratively simply be a voltage source for supplying a current to the low resistance metal layer 8 to flow through the cathode filament 16, causing it to heat and emit electrons. Coupled to the grid layer 28 is a control voltage source 48 for selectively applying a voltage to the grid layer to control the flow of electrons through the opening 32 of the grid layer, from the cathode filament 16. Of course, controlling the flow of electrons through the opening 32 effectively controls the electrons reaching the anode 40 which, by reason of a positive anode voltage source 52, attracts and receives the electrons to develop a desired electrical current. Such operation of the microminiature vacuum tube device of FIG. 1A is well-known.

Because thin film deposition may be used in constructing the microminiature vacuum tube device of FIG. 1A, micron size dimensions may be achieved. For example, the spacing between the cathode filament 16 and anode 40 may be fabricated to be from between two to fifty microns but preferably would be between about two to five microns. Similarly, the spacing between the cathode filament 16 and the opening 32 in the grid layer 28 would be between about one to three microns, and the spacing between the opening 32 and the anode 40 would be between about one to three microns. Because of the small dimensions, the device of FIG. 1A can operate at frequencies in the terahertz range and yet not suffer from velocity saturation effects that generally limit the upper frequency range of operation of other solid-state and semiconductor devices.

Although a single microminiature vacuum tube device is shown in FIG. 1A, it is apparent that a plurality of such devices could be formed on the substrate 4 with each individual device insulated and separated from one another by gaps or voids or high temperature insulator material 42 (see FIGS. 4A, 4B, 5A and 5B such as ceramic, silicon dioxide, sapphire, or the like, which would also be deposited on the substrate 46, surrounding each device.

Figure 1B:
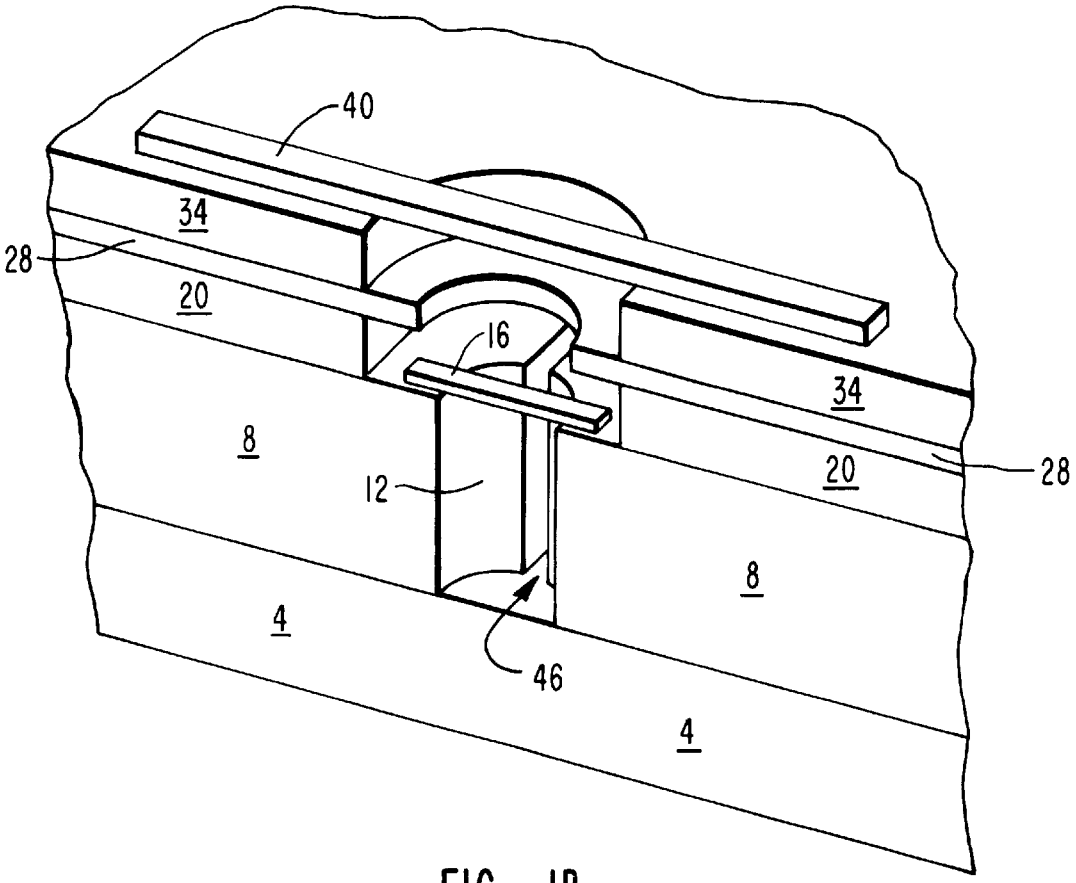
FIG. 1B is a perspective view of the thermionic vacuum tube shown in FIG. 1A.

FIG. 1B provides a perspective view of the device of FIG. 1A, which more clearly illustrates the column void 12 over which the cathode filament 16 is placed.

Figure 2A:
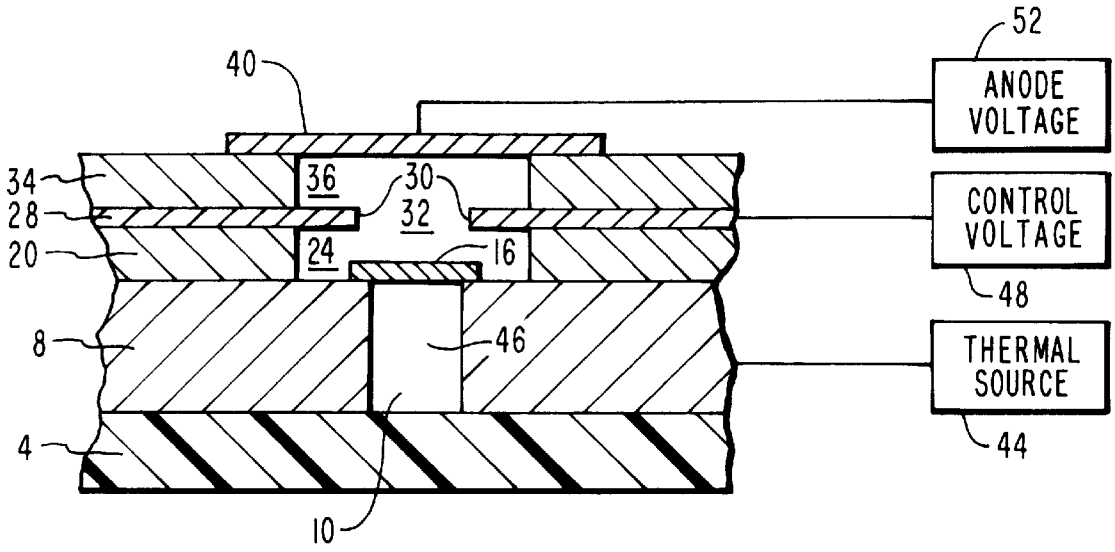
FIG. 2A is a side, cross-sectional view of a microminiature thermionic vacuum tube with a trench or trough void made in accordance with the principles of the present invention.

FIG. 2A is similar in structure to FIG. 1A with the exception that instead of a void in the shape of a column 12, the void is now in the shape of a trench or trough 10. Otherwise, the vacuum tube is constructed in the same manner as the device described in FIG. 1A.

Figure 2B:
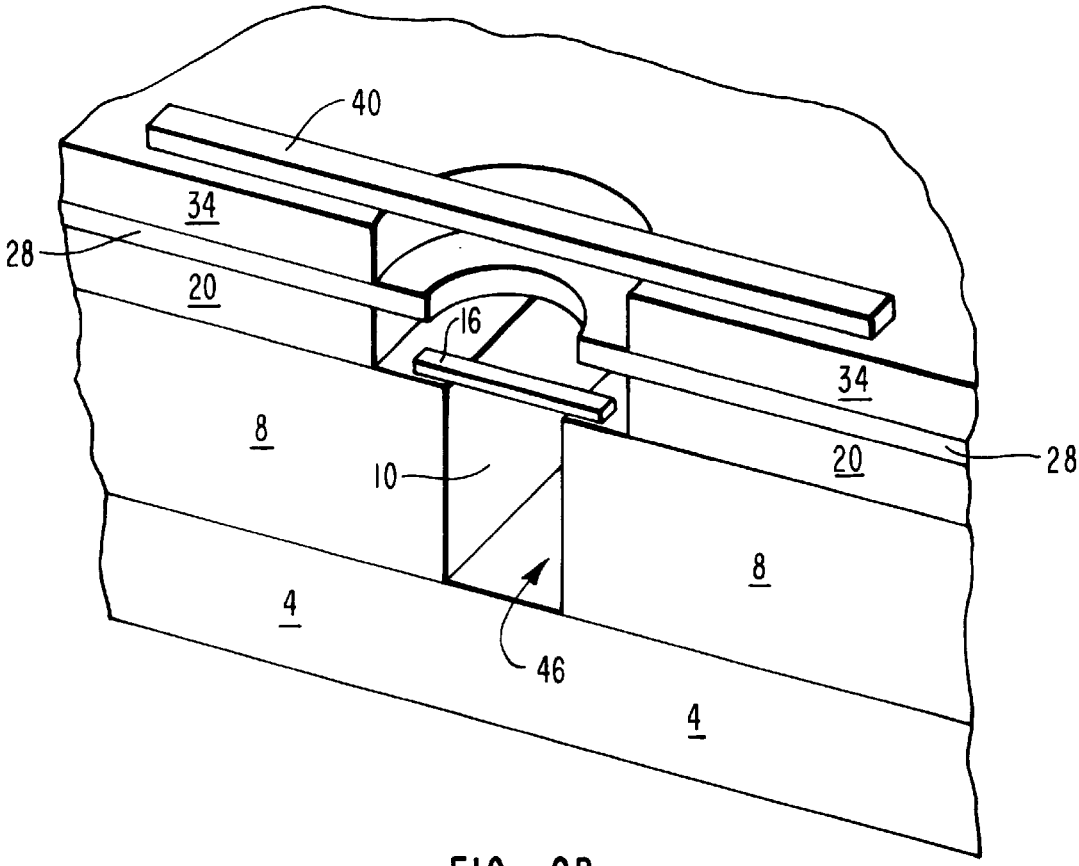
FIG. 2B is a perspective view of the thermionic vacuum tube shown in FIG. 2A.

FIG. 2B provides a perspective view of the device of FIG. 2A, which more clearly illustrates the trench or trough void 10 over which the cathode filament 16 is placed.

Figure 3A:
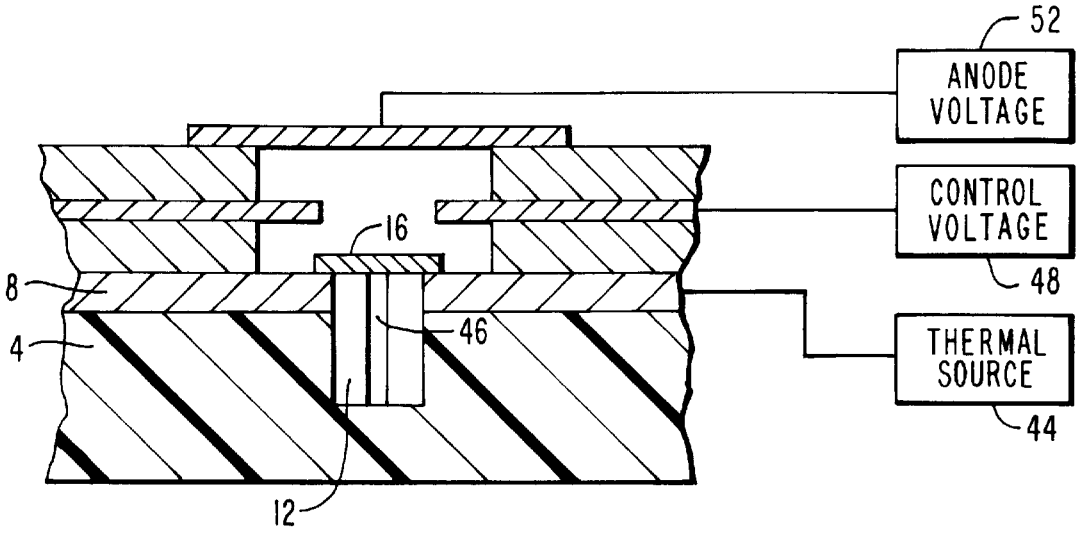
FIG. 3A is a side, cross-sectional view of another embodiment of a microminiature thermionic vacuum tube with a column void, also made in accordance with the principles of the present invention.

FIG. 3A shows an alternative embodiment of a microminiature vacuum tube made in accordance with the present invention. The FIG. 3A device is also a cross-sectional view, and shows a construction very similar to the FIG. 1A device except that the layer of low resistance metal 8 is thinner than that of the FIG. 1A device, the substrate 4 is thicker and includes a column void 12 formed in the substrate 4 directly below the cathode filament 16. The purpose of the column void 12 is to localize and isolate the cathode filament 16 to reduce the thermal load and stress which might otherwise occur on the other components of the device. The other components and structure of the device of FIG. 3A are similar to those of FIG. 1.

Figure 3B:
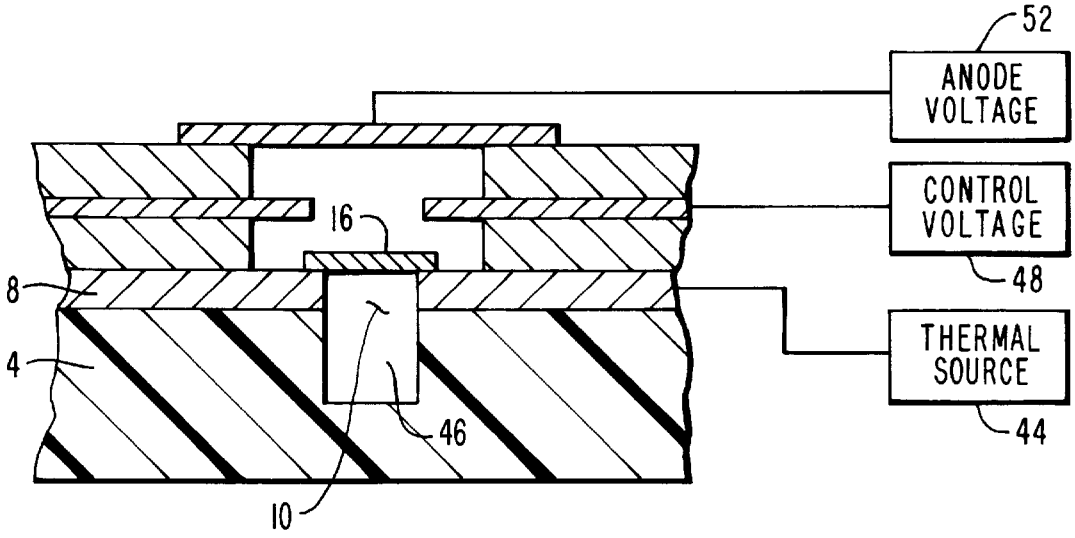
FIG. 3B is a side, cross-sectional view of the embodiment of FIG. 3A, but with a trench or trough void.

FIG. 3B is a device with the same structure as in FIG. 3A, but with trench or trough voids 10 instead of the column voids.

Figure 4A:
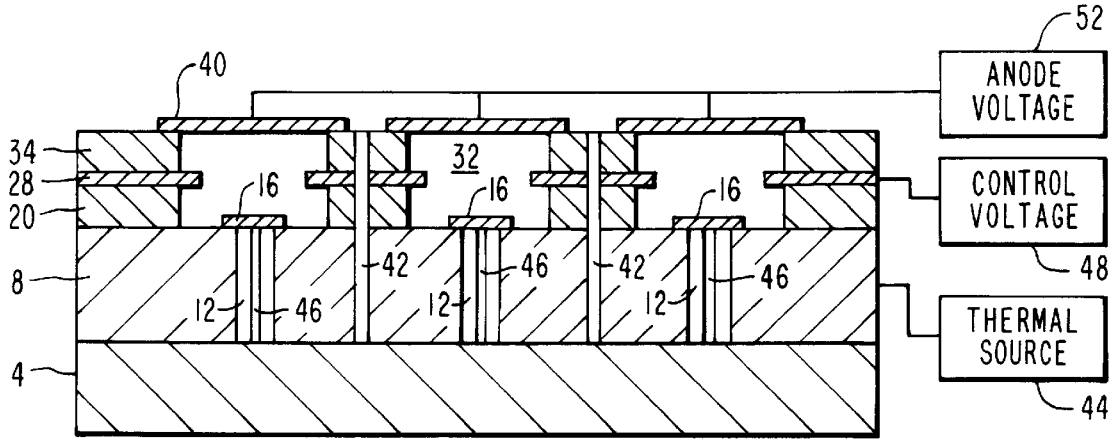
FIG. 4A is a side, cross-sectional view of the present invention similar to FIG. 1A, but having a plurality of column voids.

FIG. 4A illustrates a plurality of vacuum tube devices made in accordance with the invention as illustrated in FIGS. 1A and 1B with column voids 12, but having an insulative material 42 separating the individual devices.

Figure 4B:
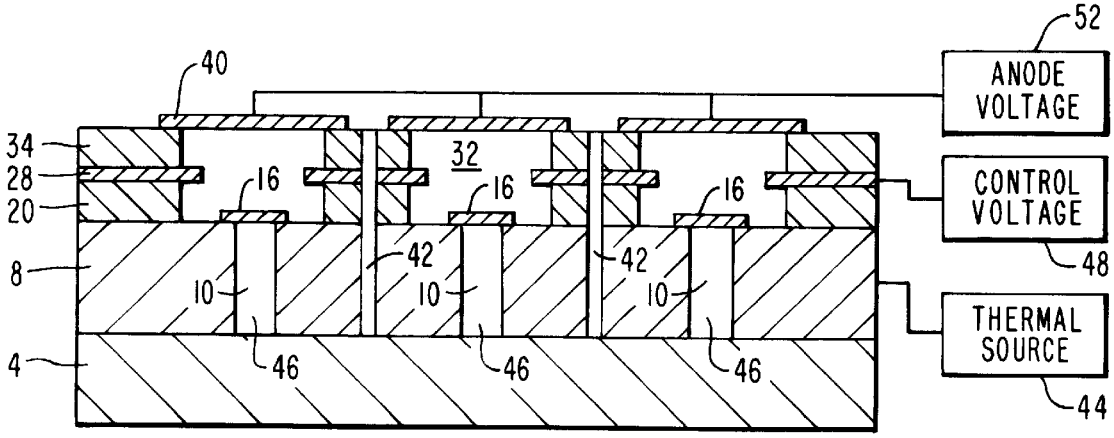
FIG. 4B is a side, cross-sectional view of the present invention similar to FIG. 2A, but having a plurality of trench or trough voids.

FIG. 4B illustrates a plurality of vacuum tube devices made in accordance with the invention as described in FIGS. 2A and 2B with trench or trough voids 10, but having an insulative material 42 separating the individual devices.

Figure 5A:
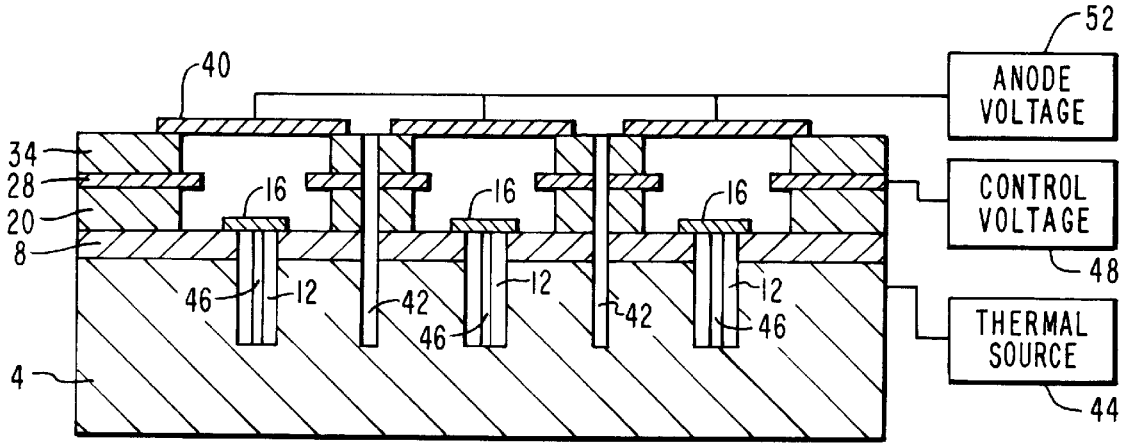
FIG. 5A is a side, cross-sectional view of the present invention similar to FIG. 3A, but having a plurality of column voids.

FIG. 5A illustrates a plurality of vacuum tube devices made in accordance with the invention as described in FIG. 3A with column voids, but having an insulative material 42 separating the individual devices.

Figure 5B:
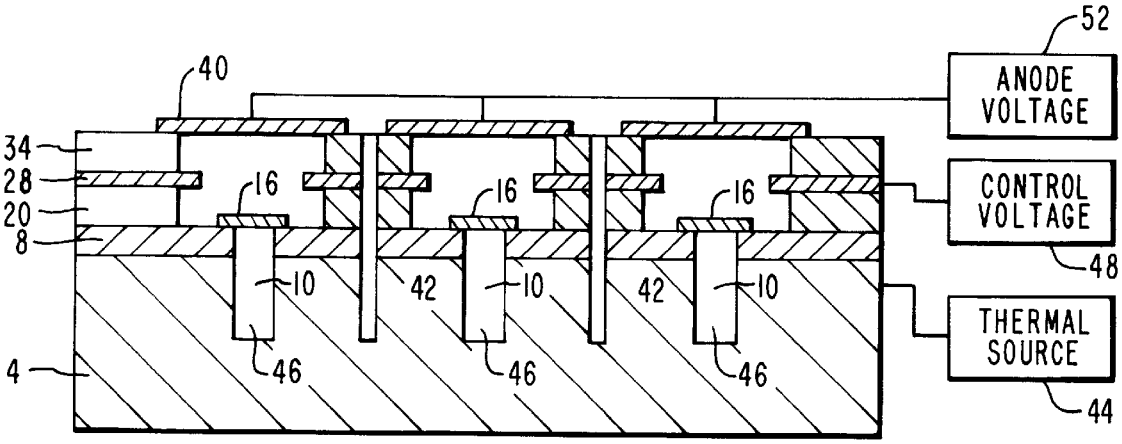
FIG. 5B is a side, cross-sectional view of the present invention similar to FIG. 3B, but having a plurality of trench or trough voids.

FIG. 5B illustrates a plurality of vacuum tube devices made in accordance with the invention as described in FIG. 3B with trench or trough voids 10, but having an insulative material 42 separating the individual devices.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A microminiature thermionic vacuum tube device comprising a substrate made of electrically resistive material, electrically conductive material disposed on the substrate to define and surround a first void extending from the substrate upwardly through the electrically conductive material, cathode means disposed on the material to bridge over the first void, for emitting electrons when heated, first electrically resistive material disposed on said electrically conductive material to surround the cathode means and define a second void thereabove, electrically conductive grid means disposed on the electrically resistive material to project partially into the second void to define an opening in the grid means above the cathode means, for allowing the passage of electrons therethrough, second electrically resistive material disposed on the grid means to define a third void above the opening in the grid means, electrically conductive anode means disposed on the second electrically resistive material over the third void to receive electrons emitted by the cathode means and passing through the opening in the grid means, and thereby produce an electrical current, means for heating the electrically conductive material to thereby heat the cathode means, and means for selectively supplying a voltage to the grid means to control the magnitude of the flow of electrons through the opening therein, and thereby control the electrical current produced in the anode means.

2. A device as in claim 1 wherein said first void extends downwardly into the substrate to form a column void below the cathode means.

3. A device as in claim 1 wherein said electrically conductive material is a low resistance metal alloy.

4. A device as in claim 3 wherein said low resistance metal alloy is selected from the group consisting of gold, aluminum, and intermetallic.

5. A device as in claim 1 wherein said cathode means is made of material selected from the group consisting of molybdenum, platinum, titanium and tungsten.

6. A device as in claim 5 wherein said grid means is made of material selected from the group consisting of tungsten, gold, and tantalum.

7. A device as in claim 6 wherein said anode means is made of material selected from the group consisting of tungsten, gold and tantalum.

8. A device as in claim 1 wherein said cathode means is made of a material having a low coefficient of expansion.

9. A device as in claim 1 wherein the spacing between the cathode means and anode means is between 2 to 50 microns.

10. A device as in claim 9 wherein the spacing between the cathode means and anode means is between 2 to 5 microns.

11. A device as in claim 9 wherein the grid means is spaced above the cathode means by 1 to 3 microns.

12. A device as in claim 1 wherein said electrically conductive material is formed to define and surround a plurality of first voids extending from the substrate upwardly through the electrically conductive material, wherein the cathode means comprises a plurality of cathodes, each disposed to bridge over a respective one of the first voids, for emitting electrons when heated, wherein said first electrically resistive material is formed to surround each of the cathodes and define a plurality of second voids, each above a respective one of the cathodes, wherein the grid means comprises a plurality of grids, each disposed to project partially into a respective one of the second voids, and each having an opening positioned above a respective cathode, wherein said second electrically resistive material is formed to define a plurality of third voids, each located above a respective one of the grids, and wherein the anode means comprises a plurality of anodes, each positioned over a respective one of the third voids.

13. A device as in claim 1, wherein said first void extends downwardly into the substrate and extends along a length perpendicular to said substrate to form a trough.

14. An integrated circuit vacuum tube array including a substrate made of electrically resistive material, a first thin film of electrically conductive material deposited on the substrate, and having a plurality of hollows formed therein, a plurality of cathodes disposed on the first material, each to bridge over a respective one of the hollows, for emitting electrons when heated, a second thin film of electrically resistive material deposited on the first material, and having a plurality of voids, each formed above and around a respective one of the cathodes, a grid layer of electrically conductive material disposed on the second material, and having a plurality of openings, each disposed over a respective void and having a smaller circumference than that of the respective void so that a portion of the grid layer projects into the voids, a third thin film of electrically resistive material deposited on the grid layer, and having a plurality of second voids, each formed above a respective opening in the grid layer, a plurality of anodes disposed on the third material, each to bridge over a respective one of the second voids, above a respective one of the openings and a respective one of the cathodes, for receiving electrons emitted by the respective cathode to thereby produce an electrical current, means for selectively heating the cathodes to cause emission of electrons, and means for selectively supplying a voltage to the grid layer to control the flow of electrons through the openings in the grid layer to thereby control the electrical current produced by the anodes.

* * * * *